United States Patent [19]

Ruggles et al.

[11] 4,014,570

[45] Mar. 29, 1977

[54] KNOT TYING ASSISTANCE CONTRIVANCE

[76] Inventors: Charles F. Ruggles, 2982 Crooked Creek Drive, Diamond Bar, Calif. 91765; Stenton A. Baruch, 2624 Midwickhill Drive, Alhambra, Calif. 91803

[22] Filed: Apr. 5, 1976

[21] Appl. No.: 673,653

[52] U.S. Cl. ..... 289/17

[51] Int. Cl.[2] ..... D03J 3/00

[58] Field of Search ..... 289/17; 28/2, 15; 223/46; 24/115 R, 129 B

[56] References Cited

UNITED STATES PATENTS

| | | | |
|---|---|---|---|
| 581,240 | 4/1897 | Nichols | 289/17 |
| 750,033 | 1/1904 | Horlacher | 289/17 |
| 776,271 | 11/1904 | Thomasson | 289/17 |
| 2,488,414 | 11/1949 | King | 289/17 X |
| 2,595,235 | 5/1952 | Emrich | 289/17 X |
| 2,691,469 | 10/1954 | Wellig et al. | 223/46 |
| 3,287,042 | 11/1966 | Baer | 289/17 |

*Primary Examiner*—Louis K. Rimrodt

[57] ABSTRACT

A knot tying assistance contrivance that will aid in the knot tying of granny, reef, square, or similar knots, comprising parts that separate the loops of specified knots; that control the loop eye size between the inner and outer half knots; that release the loops; that attach loops to contrivance; and that position line with loop-separator structure, all parts assembled so that the outer ends of line such as string, cord, sash, ribbon or rope when tensioned in the knot tying process will not tangle, thereby the loops will be free running and not overcome by resisting forces, and when the contrivance is released, the granny, reef, square, or similar knot is secured holding a resultant tensioned inner half knot.

3 Claims, 10 Drawing Figures

KNOT TYING ASSISTANCE CONTRIVANCE

By using this invention firmly tied items can be achieved by one person who can vary the tension from little to the breaking point of the line by pulling on the ends of outer half knots. Using line such as string, cord, ribbon, or rope is an old and well used method for tying packages.

Line is easy to tie, however, it has been difficult to succeed in achieving a firmly tied item or package by one person when using loop knots as specified. Assistance is sought from oneself or from another to hold the thumb or finger on the inner tensioned half knot while the outer half knot is being tensioned. With care, the tension is not lost when the loops are tied into a granny, reef, square, or similar knot.

Knots are one of man's oldest inventions. Knot tying devices such as sewing machines have been used to hold fabric together, knitting needles and crochet hooks have been used to create fabrics by knot tying, and the tying of bales by John Appleby in 1880 are examples of knotting methods.

The oldest means of untying knots is by the use of sticks and wedges. These devices have loosened untold numbers of granny, reef, square or similar knots. Also, the use of bars, levers, prongs, and similar tools to keep line from accidentally knotting is as old as their manufacture.

However, the use of a loop-separator structure, an efficient specially designed wedge, rod, or bar device to assist in tying items and packages with granny, reef, square, or similar knots securely tightened with line secured is novel.

The principal object of the invention is to provide a device which will assist in the knot tying process of granny, reef, square, or similar loop knots leaving a resultant tensioned line by manually operating the device while pulling on the outer half knot ends, or by only pulling on the outer half knot ends and having an automatic or semi-automatic release.

Another object of the invention is to keep the tying loops separated by a geometrical means of loop separation, a loop-separator structure.

Another object of the invention is to close the loop eye of the knots through a control means. A loop eye sizer means control keeps the inner and outer loops from premature closure.

Another object of the invention is to provide a means for the transfer of the pulling forces to the inner half knot.

Another object of the invention is to provide the machine with a release means for releasing the combination of the loops and the contrivance from each other at preferred tension.

Another object of the invention is to provide a holding means for the untied line, line loop, or line loops prior to tensioning. The contrivance holding means attaches the line in good position and allows line to be lifted in loose position without losing contact with the machine.

Other objects and advantages of the invention will become better understood hereinafter from a consideration of the specifications with reference to the accompanying drawings forming a part thereof, and in which like numerals correspond to like parts throughout the several views of the invention, and wherein.

Figure 1:
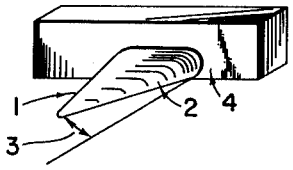
FIG. 1 is a perspective view of a manually operated knot tying assistance contrivance with a loop-separator structure, and with reference to other elements.
Figure 2:
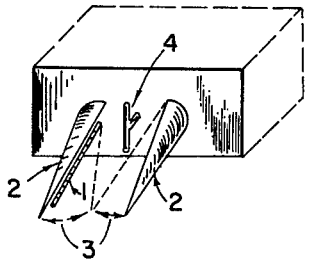
FIG. 2 is a perspective view of an automatic knot tying assistance contrivance with a loop-separator structure, and with reference to other elements with loop-separator in open position.
Figure 3:
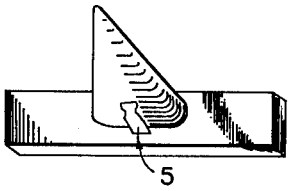
FIG. 3 is a perspective view of a manually operated knot tying assistance contrivance with reference to other elements showing a modification with a holding means for the line.
Figure 4:
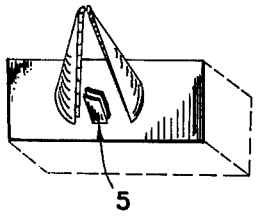
FIG. 4 is a perspective view of an automatic knot tying assistance contrivance with reference to other elements showing a modification with a holding means for the line and with loop-separator and release in closing positions.
Figure 5:
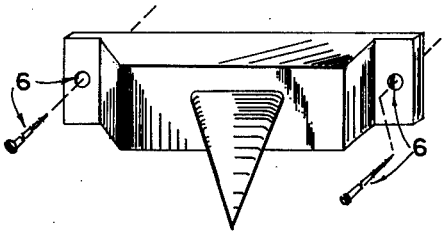
FIG. 5 is a perspective view of a knot tying assistance contrivance showing a modification with a retaining means.
Figure 6:
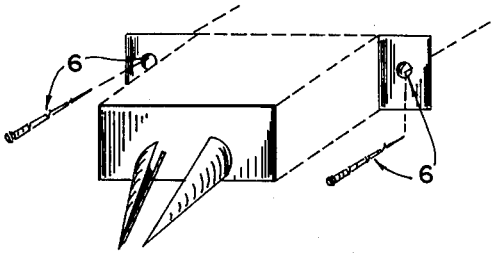
FIG. 6 is a perspective view of an automatic knot tying assistance contrivance showing a modification with a retaining means.
Figure 7:
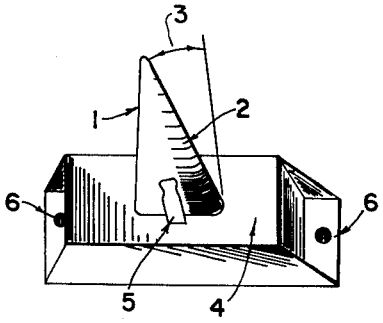
Figure 8:
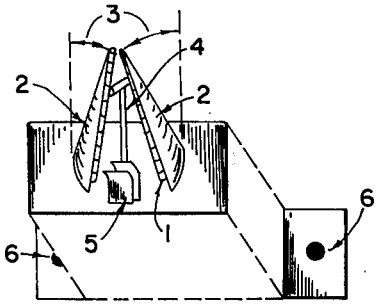

FIG. 7 is a perspective view of a knot tying assistance contrivance with reference to other elements showing a complete loop-separator structure with all modifications, and FIG. 8 is a perspective view of an automatic knot tying assistance contrivance with reference to other elements showing a complete loop-separator structure with all modifications and with loop-separator and release at closed position.

Figure 9:
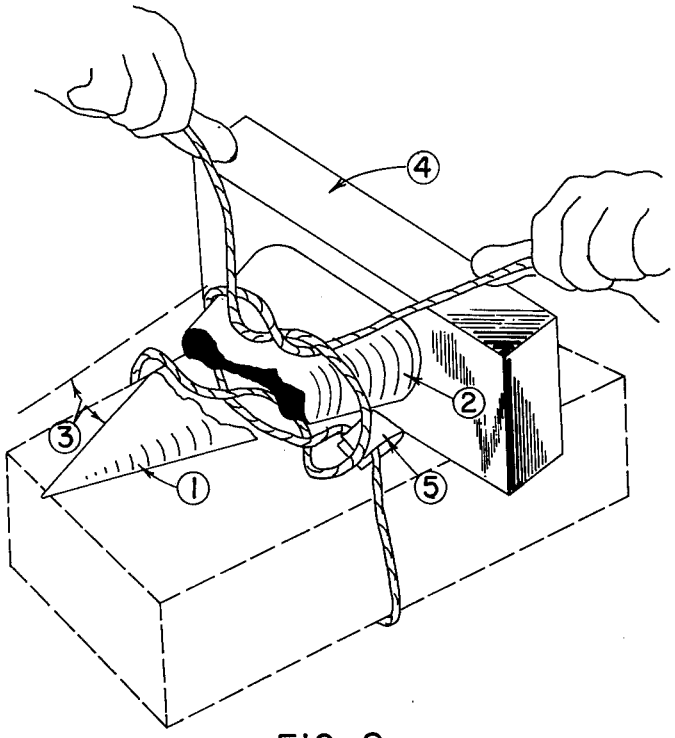

FIG. 9 is a tying diagram showing the strands and how the contrivance is used in forming knots in the tying process.

Figure 10:
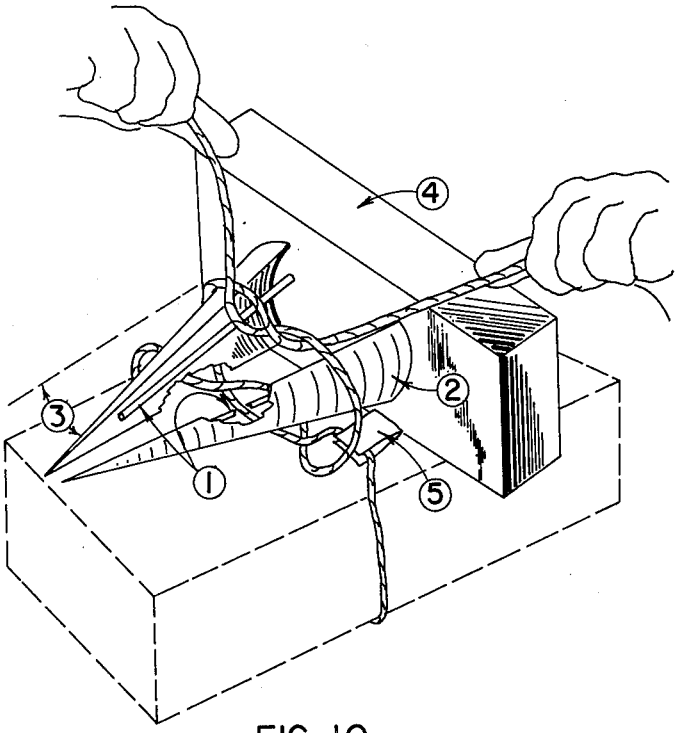

FIG. 10 is a tying diagram showing the strands and how the automatic contrivance is used in forming knots in the tying process.

Referring now to the drawing reference numerals 1, 2, 3, 4, 5, and 6, in FIGS. 1 through 8, designate parts that comprise the contrivance and the principles of design and are representative of the claims but do not limit the variation of means to accomplish the purpose.

Part 1 designates a loop-separator structure means keeping said knots untied, and consists of one or more basic structural elements that are connected to form a means for keeping the half knots of specified knots from being tied. The elemental structure may be a rod, a bar or any complex shape. A loop-separator structure 1 may be one or more structural shapes and may be continuous such as a U bar, or discontinuous such as two or more prongs connected to a bar to form a U bar, or complex shape; or may be elements connected on a common or uncommon point or pivot, with such parts located and positioned to function as a unit in keeping half knots separated. The loop-separator structure 1 is an essential part of the contrivance for its functional ability to keep half knots separated during the knot tying process.

Part 2 designates a means for transferring tension from pulled line ends through line to inner half knot. The transfer of tension from the outer half knot ends to the inner half knot is accomplished by reducing the surface friction on which the half knots are formed or by controlling the sharpness of corners, or by providing friction free methods to keep the line from binding and the half knots from binding. Tying of specified knots has relied on the inner knot being the first tensioned, but a means for transferring tension 2 reverses the process; thus a means for transferring tension 2 functions as a part of the contrivance permitting the inner half knots to be pulled from the outer half knot ends.

Part 3 designates a means for controlling the size of the loop between the outer and inner half knots of said knot when the ends of the outer half knot are tensioned. A structure that will control the loop eye size can be a fixed, or a movable, or a collapsible structure, or any combination of said structures and be uniform or non-uniform in size before coming to closure. The means for controlling the size of the loop 3 is to control its distance between half knots before knotting takes place. The said means 3 is included as an effective method of controlling the distance between the half knots in the line before knotting.

Part 4 designates a means for releasing the combination of the tensioned half knots and the loop-separator structure 1 from each other. The means for releasing 4 permits the tensioned half knots to be pushed or pulled, or the device to be pushed or pulled, or the movement to be the combination of a push and pull parallel to the loop-separator structure 1. The releasing force is either from the tensioned half knots or from an applied force which will cause a reaction great enough to cause the device to be released at proper time and correct tension. The means of releasing 4 is used to obtain the proper tying line tension during the time of operation. The kinds of releasing 4 may be of various styles, shapes, and forms, and be of several combinations of device. The means of releasing 4 is included as a prime factor of this invention since the knot cannot be secured while the half knots remain separated.

Part 5 designates a means of holding the device to the line prior to tensioning and is an improvement in the basic design. The positioning and clipping of loose line to the contrivance maintains the line in place while twisting is taking place. The means of holding the device 5 may be hooks, knobs, poles, bars, springs, pressure devices or other such devices that keep string loosely attached. A means of holding 5 is specified for its functional ability to position and hold line and is an assistance in keeping line and half knots held to contrivance before the ends of either half knot are pulled to tension.

Part 6 designates a means of retaining said knot tying contrivance to a fixture and is an improvement in the basic design. The retaining of the device in an unmovable position allows the operator to move the two half knots and the line in reference to the fixed device. A means for retaining 6 is specified for its functional ability to keep the device fixed while line is moved, and is an assistance in the knot tying process.

Now that Parts 1, 2, 3, 4, 5, and 6 have been specified, the operational use of the machine is as follows:

The operator wraps a line around an item; then makes a twist in the free ends of a line, known as a "half knot"; the device is then placed next to the line, or held to the line by a means of holding device 5 which is threaded to the device; then the operator proceeds to make a loop around the loop-separator structure 1 with each of the free ends; then he makes another twist with the free ends; then he pulls the free ends of the line so that the line contacts a means for transferring tension 2 during which time a means for controlling the size of the loop 3 keeps the loop eye at a preferred size; then the operator tensions the line to proper tension and uses the means for releasing 4 the loop-separator structure 1 and the outer half knot from each other, and the knot is released, leaving a secured knot with a tension tied line. Also, the operation is similar for the device when a means of retaining 6 is used to keep device in a fixed position.

Having described the invention, it is to be understood that certain modifications and arrangements of the parts thereof will be made as deemed necessary without departing from the scope of the appended claim:

We claim:

1. A device that permits an inner half knot of a granny, reef, square or like knot to be brought to tension and secured with an outer half knot when the ends of the outer half knot are pulled, and is a knot tying assistance contrivance of original type consisting of curved and tapering surfaces comprising a loop-separator structure means keeping half knots of granny, square, reef or similar knots untied; with a means for transferring tension from the pulled line ends through an outer half knot, through the loop formed around the loop-separator, through the inner half knot to the line around the item, with said means being connected to the loop-separator structure; having a means for controlling the size of the loop eye between the outer and inner said half knots with said means connected to said loop-separator structure; and having a means for releasing the combination of the half knots and the loop-structure with said means connected to the loop-separator structure, thereby tying the line as tensioned with said knots; whereby the knot tying assistance contrivance functions as an assistant for tying of the specified knots leaving a secured knot and a tensioned tied line.

2. A device as defined in claim 1 having a means for holding the device to the line prior to tensioning the loops.

3. A device as defined in claim 1 having a means for retaining said knot tying contrivance to a fixture.

* * * * *